US007175209B2

(12) United States Patent
Cetnar et al.

(10) Patent No.: US 7,175,209 B2
(45) Date of Patent: Feb. 13, 2007

(54) CLIP FOR HOLDING A RELEASE LEVER OF A VEHICLE LATCH DURING SHIPPING

(75) Inventors: Roman Cetnar, Newmarket (CA); Jakub Rucinski, Toronto (CA)

(73) Assignee: Intier Automotive Closures Inc., Newmarket (CA)

( * ) Notice: Subject to any disclaimer, the term of this patent is extended or adjusted under 35 U.S.C. 154(b) by 0 days.

(21) Appl. No.: 10/505,508

(22) PCT Filed: Feb. 25, 2003

(86) PCT No.: PCT/CA03/00252

§ 371 (c)(1),
(2), (4) Date: Jan. 31, 2005

(87) PCT Pub. No.: WO03/071066

PCT Pub. Date: Aug. 28, 2003

(65) Prior Publication Data

US 2005/0127682 A1 Jun. 16, 2005

(51) Int. Cl.
*E05C 19/10* (2006.01)

(52) U.S. Cl. ..... 292/100; 292/DIG. 64; 292/DIG. 53; 403/12

(58) Field of Classification Search ..... 292/100, 292/210, 201, DIG. 56, DIG. 64 X, DIG. 53; 403/12 X, 11, 326, 329 X; 248/68.1, 73, 248/74.1, 74.3; 280/730.2, 728.2
See application file for complete search history.

(56) References Cited

U.S. PATENT DOCUMENTS 3,088,702 A * 5/1963 Orenick et al. ..... 248/71
4,482,265 A * 11/1984 Koza ..... 403/71
4,929,007 A 5/1990 Bartczak et al.
5,308,129 A 5/1994 Hlavaty
5,407,160 A * 4/1995 Hollingsworth et al. ..... 248/220.43
5,492,379 A 2/1996 Staser et al.
5,511,838 A 4/1996 Baughman et al.
5,622,396 A 4/1997 Neumann
5,660,420 A 8/1997 Smith et al.
5,662,396 A 9/1997 Reeder et al.
5,709,498 A * 1/1998 Sova et al. ..... 403/196
5,934,817 A * 8/1999 Kim et al. ..... 403/196
6,231,109 B1 * 5/2001 Beaver ..... 296/97.9
6,254,148 B1 7/2001 Cetnar
6,322,274 B1 * 11/2001 Binotti et al. ..... 403/13
6,514,027 B1 * 2/2003 Yiu et al. ..... 411/433

(Continued)

FOREIGN PATENT DOCUMENTS

DE 198 40 464 9/1998

(Continued)

*Primary Examiner*—Brian E. Glessner
*Assistant Examiner*—Mark Williams
(74) *Attorney, Agent, or Firm*—Clark Hill PLC

(57) ABSTRACT

A clip and a vehicle latch is provided for properly positioning an operational lever of the latch. The latch has a housing with an aperture. The clip is mounted on the lever. The clip has a base portion hingedly connected to a top portion and pivots between a closed condition and an open condition. The top portion has a hook that engages the aperture of the housing when the lever is in a predetermined position and when the top portion is in the open condition. The clip properly positions the lever for properly connecting the lever to a rod to operatively connect the latch to a release handle.

8 Claims, 4 Drawing Sheets

U.S. PATENT DOCUMENTS

| | | | | |
|---|---|---|---|---|
| 6,602,035 | B1 * | 8/2003 | Parker | 411/340 |
| 6,924,975 | B2 * | 8/2005 | Lai | 361/683 |
| 6,962,470 | B2 * | 11/2005 | Anscher | 411/433 |
| 2001/0007394 | A1 * | 7/2001 | Beaver | 296/97.9 |
| 2005/0285375 | A1 * | 12/2005 | Kawai et al. | 280/728.2 |

FOREIGN PATENT DOCUMENTS

| | | |
|---|---|---|
| EP | 1 160 402 | 5/2001 |
| WO | WO 00/49254 | 8/2000 |

* cited by examiner

CLIP FOR HOLDING A RELEASE LEVER OF A VEHICLE LATCH DURING SHIPPING

FIELD OF THE INVENTION

This invention relates to a clip for holding a lever of a vehicle latch, in particular a release lever, during shipping and installation.

BACKGROUND OF THE INVENTION

Vehicle latches generally comprise a housing, a ratchet, a pawl, an inside release lever, an outside release lever, an inside locking lever, and an outside locking lever. The various levers are operably coupled to the pawl to effect the various functions of the latch. Examples of typical latches are disclosed in U.S. Pat. Nos. 4,929,007 and 6,254,148.

Each of the various levers are operably connected, typically via a Bowden cable or rigid rod, to a respective handle or lever. A Bowden wire can be adjusted after the lever is installed. However, a rigid rod cannot be adjusted after the clip connecting the release lever to the rod has been closed. If the release lever is not in the correct position for installation, the attachment of the release lever with the clip will leave the release lever in a less than an optimum position. If the release lever is unable to return to the designed rest or ready position, the release lever may block or prevent the locking lever from freely moving preventing the latch from fully locking or unlocking.

In current production latches for Volkswagen and Audi, the latch is provided with a spring that biases the release lever to the designed rest or ready position to ensure that the latch can be properly installed. Once the latch is installed and attached to the rigid rod to operably connect the release lever to the outside handle, the spring is disengaged from the release lever, allowing normal operation of the latch. The spring can be re-engaged for re-installation after service; However, in normal operation, the spring provides no useful function.

SUMMARY OF THE INVENTION

The disadvantages of the prior art may be overcome by providing a latch having at least one release lever that is operably connectable to a handle. The lever has an aperture for receiving a folding clip having a fold-over portion. The latch has a housing configured to receive the fold-over portion of the clip to hold the clip and the lever in the "ready" position during shipping and installation.

According to one aspect of the invention, there is provided a clip and a vehicle latch. The latch has a housing with an aperture. The clip is mounted on a lever. The clip has a base portion hingedly connected to a top portion and the top portion pivots between a closed condition and an open condition. The top portion has a hook that engages the aperture of the housing when the lever is in a predetermined position and when the top portion is in the open condition. The clip positions the lever for properly connecting the lever to a rod to operatively connect the latch to a release handle.

According to another aspect of the invention, a clip and a vehicle latch are provided. The latch includes a housing and at least one lever extending from the housing. The housing includes a first part of a detent mechanism. The clip is mounted on the lever and includes a top portion hingedly connected to a bottom portion. The top portion pivots so as to move between a closed condition and an open condition. The top portion of the clip includes a second, mating part of the detent mechanism engageable with the first part of the detent mechanism when the top portion is in the open condition, thus locating the lever in a predetermined position to be able to connect the latch to a release handle.

BRIEF DESCRIPTION OF THE DRAWINGS

In drawings that illustrate embodiments of the invention.

DETAILED DESCRIPTION OF THE INVENTION

Figure 1:
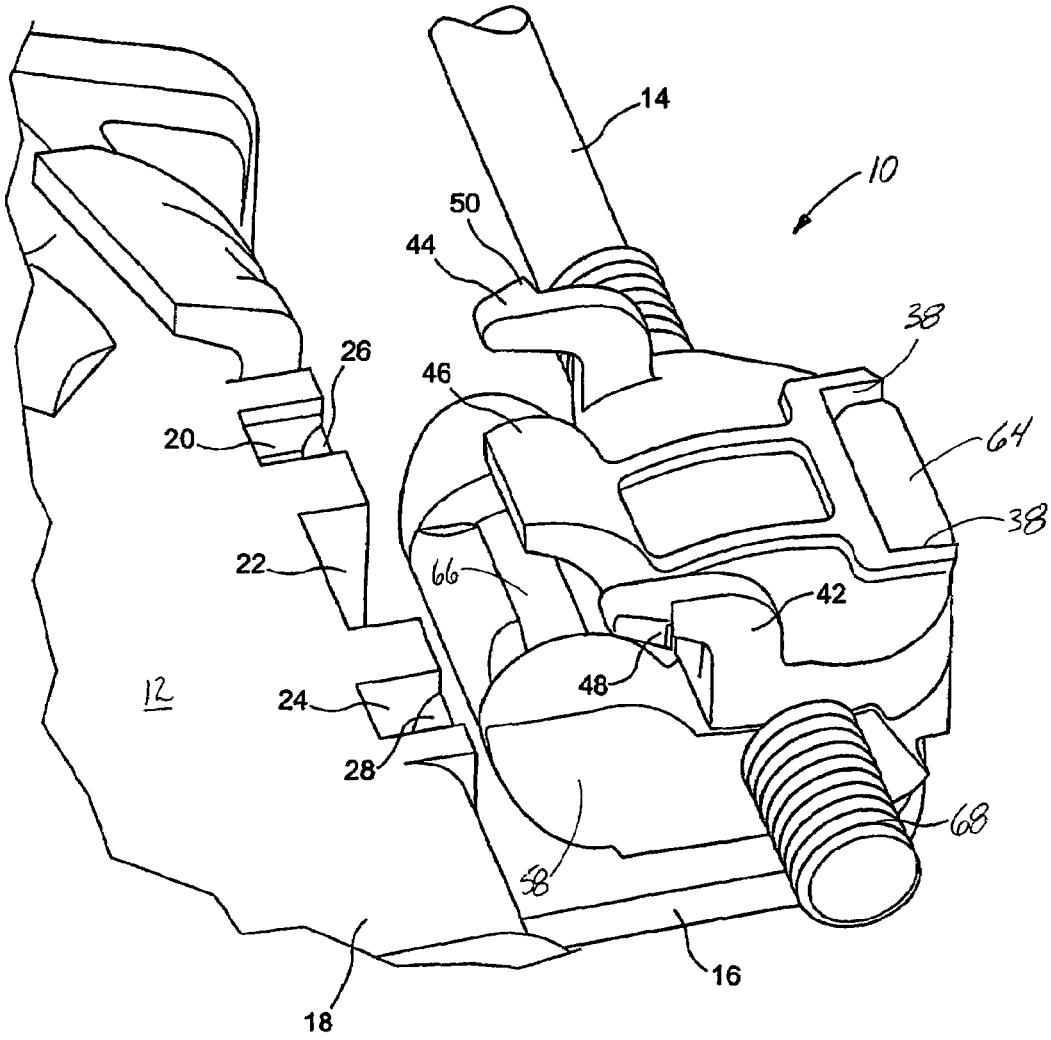
FIG. 1 is a perspective view of clip and latch assembly according to the preferred embodiment, installed on a rigid rod.

FIG. 1 illustrates a clip 10 and latch 12 of the present invention, mounted to a rigid rod 14. Clip 10 is mounted on a lever 16 of the latch 12. Typically, latch 12 can have 4 levers, an inside and outside locking lever and an inside and outside release lever. Although the invention could be applied to any of these levers, the invention is preferably applied to the outside release lever for an operative connection to an outside door handle.

Latch 12 can be of any conventional construction and design. The housing 18 of the latch has a number of openings, the lever 16 extending from one of these openings. Proximate to the location of the lever, the housing 18 is configured to releasably receive an upper portion of clip 10. In the preferred embodiment, the housing has at least one aperture 20, 22 and 24. Apertures 20 and 24 are locking apertures. The lead or entry portions 26, 28 of the apertures are tapered. Aperture 22 is a guide aperture with the lead or entry portion open.

Figure 2:
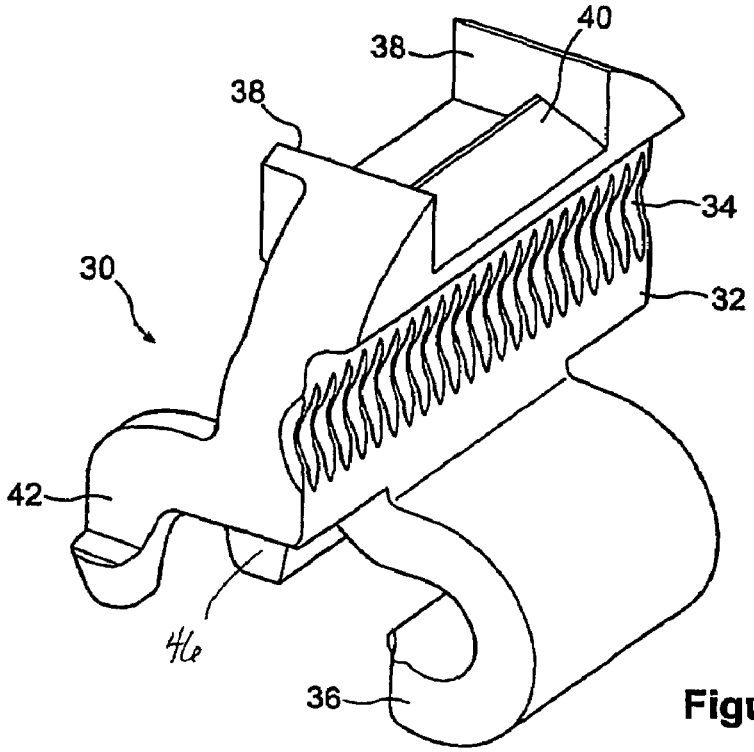
FIG. 2 is perspective view of the top portion of the clip of the embodiment of FIG. 1.
Figure 3:
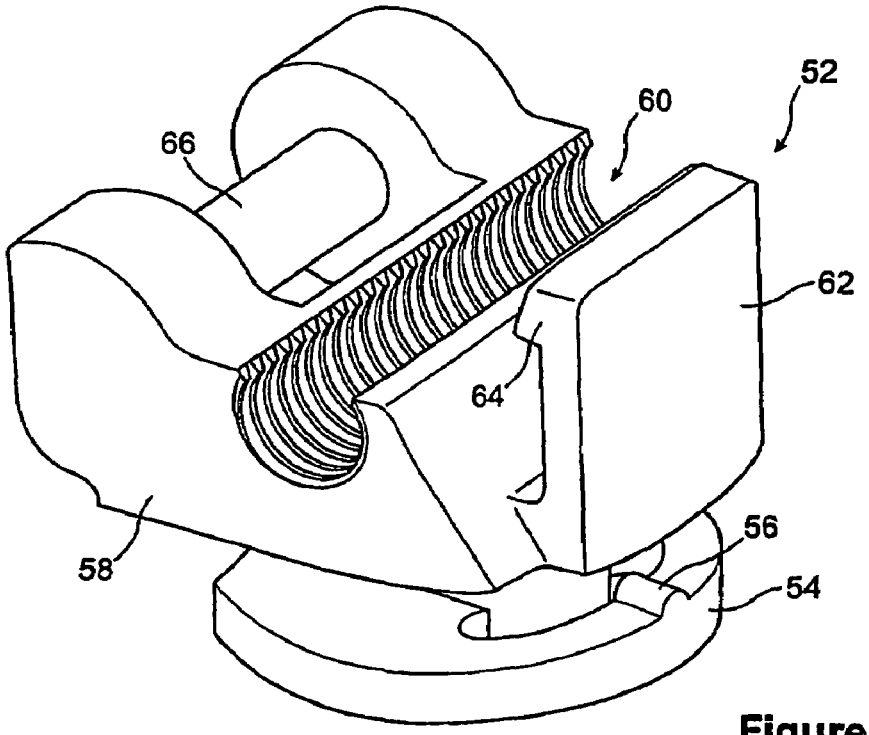
FIG. 3 is a perspective view of the bottom portion of the clip of FIG. 1.

Referring to FIGS. 2 and 3, the clip 10 is illustrated in greater detail. The clip is generally of the "Mazda" style clip that is widely utilized in the automotive industry for attaching rigid rods to latch assemblies. Clips of this type are more particularly described in WO 00/49254.

The clip 10 has a top portion 30 comprising a main body 32. The inner face of the body 32 has a series of ridges 34 on an arcuate surface. A hook 36 extends from the body 32. The front face of the body has guide walls 38 and a detent 40. The rear face of the body 32 has locking hooks 42, 44 and a guide hook 46 (FIG. 1) that extend outwardly and arcuately therefrom. The locking hooks 42, 44, each has a detent 48, 50.

Referring to FIG. 3, a base portion 52 is illustrated. The base portion has a mount portion 54. The mount portion 54 is configured to engage with an aperture on lever 16 to be secured thereto. Mount portion 54 optionally has a detent 56 to engage a corresponding cavity formed in the underside of lever 16 and thereby orient the clip 10 relative to the housing 18.

The base portion 52 has a body 58. The body 58 has a channel 60 with a series of serrations or ridges. The front face of the body 58 has a hook 62, sized to fit between walls 38 of top portion 30. The hook 62 has a detent or barb 64 that engages detent 40. The rear face of body 58 has an axle 66.

Hook 36 engages axle 66 for pivotal movement about the axle 66. Ridges 34 cooperates with channel 60 to lockingly engage with threads 68 of rod 14 positioning the clip 10 therealong.

Apertures 20, 22, 24 are located and spaced on the housing 18 such that the hooks 42, 44, 46 will respectively engage the apertures and also position the lever 16 in the desired location for proper connection to the rod 14 and proper orientation of the latch 12.

Figure 4:
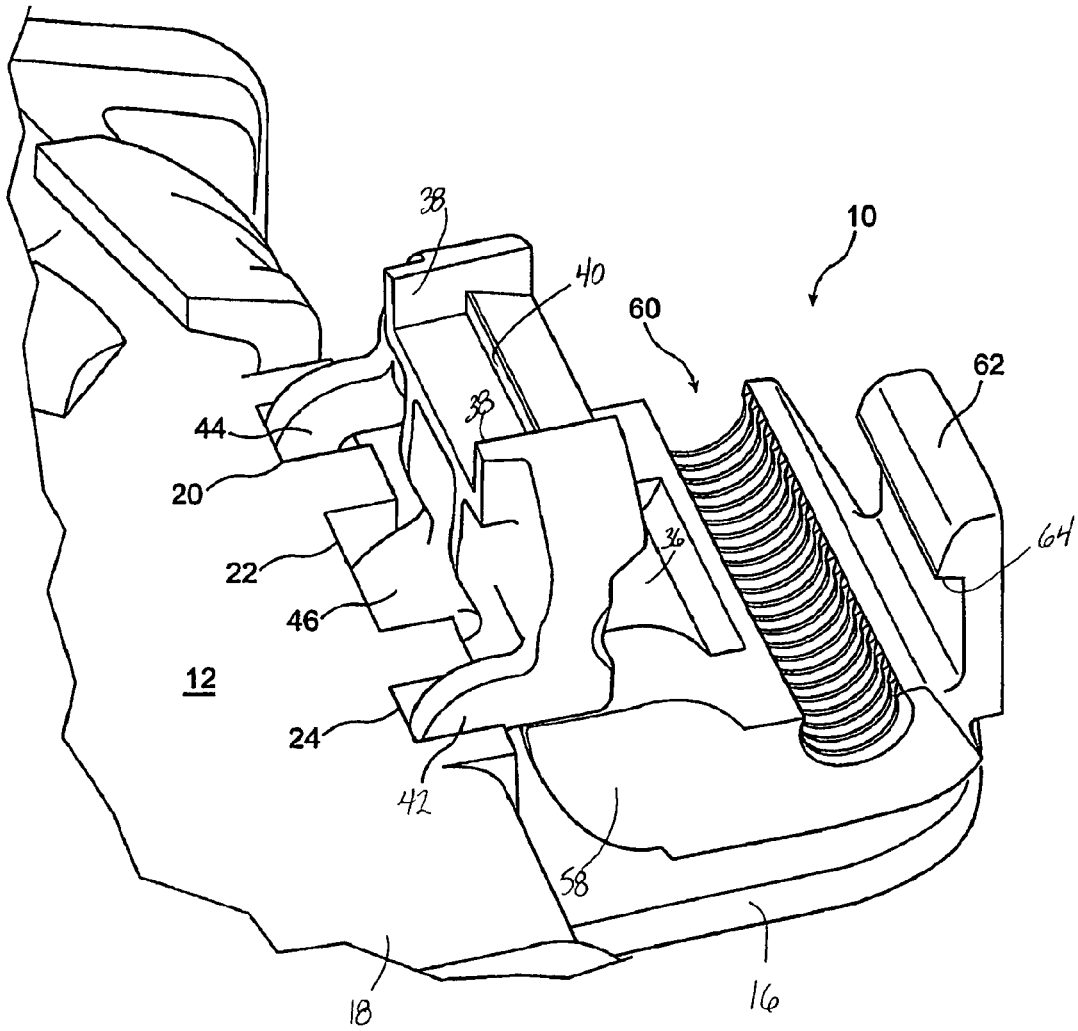
FIG. 4 is a perspective view of the embodiment of FIG. 1 with the clip in the open, shipping and installation condition.

Referring to FIG. 4, the clip 10 and latch 12 are illustrated in the shipping condition. The clip 10 is installed on the lever 16 in a known and conventional manner. The clip 10 is opened by rotating top portion 30 and the hooks 42, 44, 46 are inserted into the respective apertures 20, 22, 24 until the detents 48, 50 engage the underside of the housing 18 in a snap fit, locking the top portion 30 in the open position. Hook 46 guides the opening of the top portion 30 and holds the clip 10 and lever 16 in the desired installation position.

Figure 5:
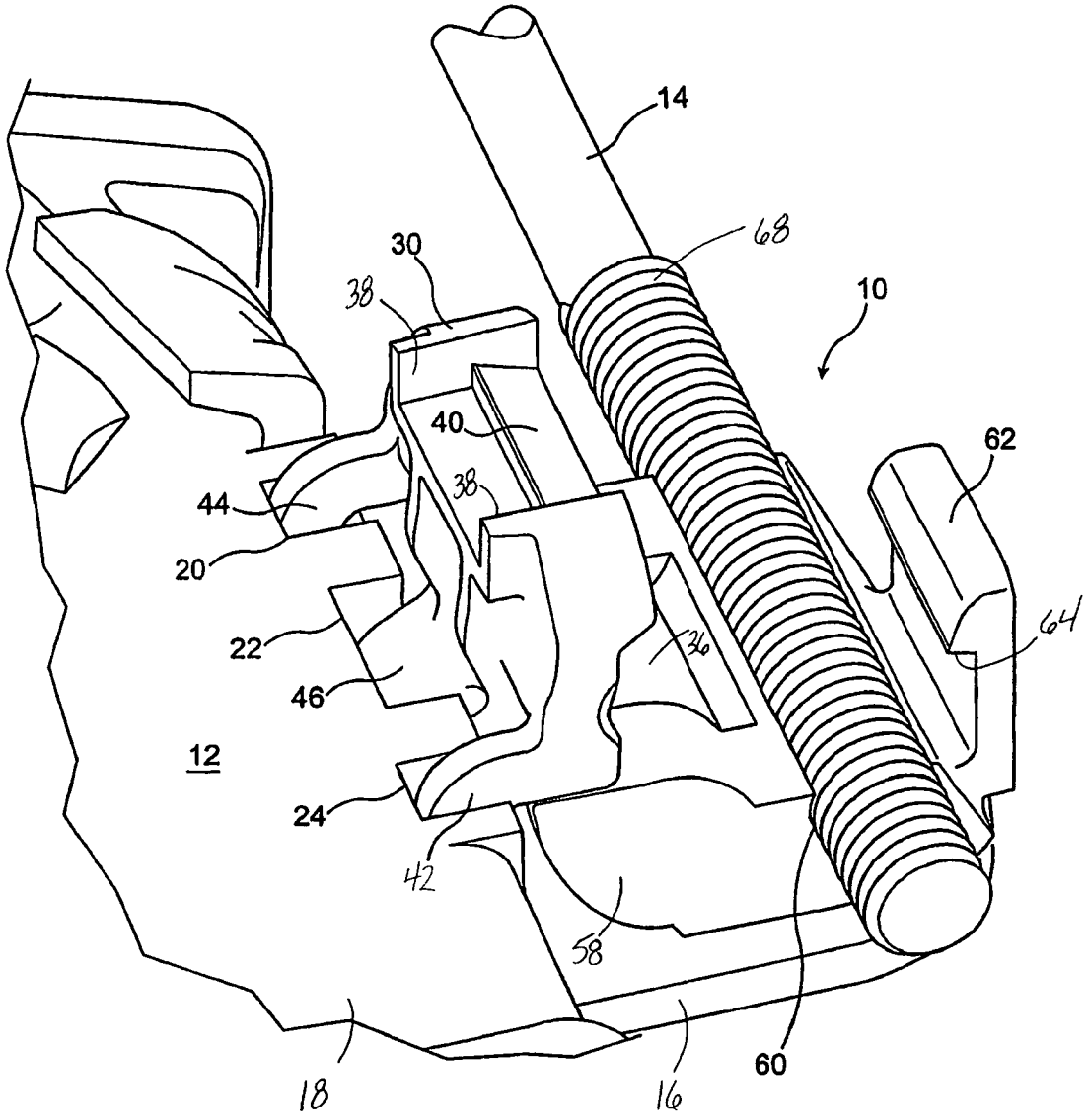
FIG. 5 is a perspective view of the embodiment of FIG. 1 with the rod being applied to the clip.

Referring to FIG. 5, the rod 14 applied to the channel 60 after the opposite end of the rod 14 is attached to the release handle assembly. Once the rod 14 is properly positioned, the top portion 30 is rotated to the closed position by pulling the locking hooks 42, 44 from the apertures 20, 40 overcoming the bias of the locking hooks 42, 44. The top portion 30 is rotated until the detent 40 engages the detent 64 and locks to hook 62, securely locking the rod 14 within the clip 10 and ultimately to the lever 16.

The present invention insures that the rod 14 is properly installed relative to the latch 12. If the latch 12, release handle or rod 14 are required to be serviced, the clip 10 is opened and the hooks 42, 44, 46 are re-inserted into the apertures 20, 22, 24 to properly position the lever 16 relative to the latch 12.

It will be appreciated that the detent mechanism shown for removeably locking the top portion of the clip to the housing may be varied from the specific embodiment shown in the drawings. For example, the male part of the detent mechanism may be located on the housing and the female part of the detent mechanism may be located on the top portion of the clip. Different interconnect profiles may also be used in the alternative. Similarly, although various preferred embodiments of the invention have been described in detail, it will be appreciated by those skilled in the art that many other variations may be made to the preferred embodiments without departing from the spirit of the invention.

The invention claimed is:

1. In combination, a vehicle latch and a clip for operatively connecting a connecting member of a release handle to said vehicle latch:

said vehicle latch comprising a housing and at least one lever extending from said housing;

said clip comprising a base portion mounted to said at least one lever and a top portion pivotally coupled to said base portion for movement between an open position spaced apart from said base portion for receiving the connecting member and a closed position engaging said base portion and securing the connecting member to said clip between said top portion and said base portion; and said housing of said vehicle latch having an aperture and said top portion of said clip having a guide hook wherein said guide hook is matingly engaged with said aperture when said clip is in said open position thereby maintaining said at least one lever in a predetermined position for coupling with the connecting member and disengaged from said aperture when said clip is in said closed position thereby coupling said at least one lever between said vehicle latch and the connecting member of the release handle.

2. A combination as set forth in claim 1 wherein said top portion includes at least one locking hook having a first detent and said vehicle latch includes at least one locking aperture having a second detent whereby said first detent engages said second detent when said top portion is in said open position.

3. A combination as set forth in claim 2 wherein said top portion includes a second locking hook having a first detent and said vehicle latch includes a second locking aperture having a second detent whereby said first detent engages said second detent when said top portion is in said open position.

4. A combination as set forth in claim 3 wherein said top portion includes a hook pivotally coupled to an axle on said base portion for providing pivotal movement of said top portion between said open and closed positions.

5. A combination as set forth in claim 4 wherein said top portion includes a detent and said base portion includes a hook for locking said clip in said closed position.

6. A combination as set forth in claim 5 wherein said base portion includes a channel for matingly receiving the connecting member therein.

7. A combination as set forth in claim 3 wherein one of said first detent of said second locking hook and said second detent of said second locking aperture is a male detent and the other is a female detent.

8. A combination as set forth in claim 2 wherein one of said first detent of said at least one locking hook and said second detent of said at least one locking aperture is a male detent and the other is a female detent.

* * * * *